United States Patent [19]

Weiler

[11] 4,108,387

[45] Aug. 22, 1978

[54] HOLLOW PIN ASSEMBLY FOR FOOD GRINDERS

[75] Inventor: James G. Weiler, Elkhorn, Wis.

[73] Assignee: Weiler and Company, Whitewater, Wis.

[21] Appl. No.: 781,240

[22] Filed: Mar. 25, 1977

[51] Int. Cl.[2] ..... B02C 18/36

[52] U.S. Cl. ..... 241/82.5

[58] Field of Search ..... 241/82.1, 82.2, 82.3, 241/82.4, 82.5, 82.6

[56] References Cited

U.S. PATENT DOCUMENTS

| | | | |
|---|---|---|---|
| 676,461 | 6/1901 | Geisel | 241/82.4 |
| 908,348 | 12/1908 | Stenz | 241/82.3 |
| 1,021,000 | 3/1912 | Mitchell | 241/82.5 |
| 3,536,115 | 10/1970 | Weiler | 241/82.5 |

*Primary Examiner*—Granville Y. Custer, Jr.

*Attorney, Agent, or Firm*—Wheeler, Morsell, House & Fuller

[57] ABSTRACT

A hollow pin set in the downstream end of the auger of a conventional food grinder has a downstream end which protrudes to an accessible outside area of the grinder and a downstream - facing shoulder which bears against the upstream side of the knife assembly of said grinder, biasing said knife against a perforated plate. An inside pin or bolt passes through the hollow pin, threadably connected therewith, and has a downstream end which protrudes from the hollow pin and which is adapted to receive a wrench. The upstream end of said inside pin or bolt presses against a compression spring. Applying a wrench to rotate the downstream end of said inside pin or bolt changes the compression of the spring and thereby increases or decreases the bias between said knife assembly and the perforated plate which the knife is biased against.

6 Claims, 3 Drawing Figures

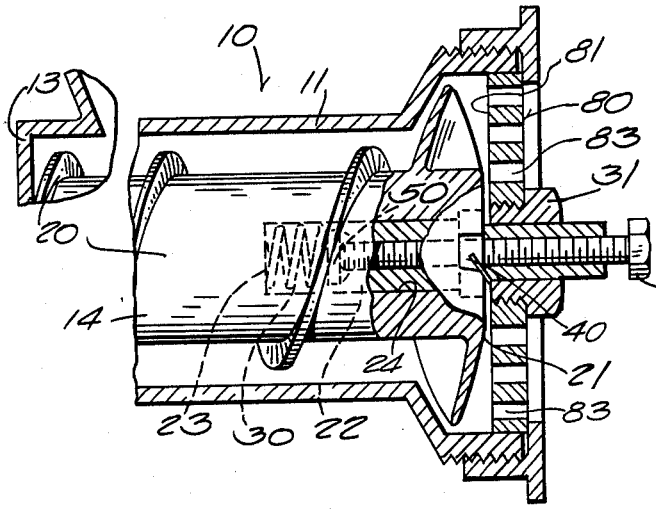
Fig. 1
Fig. 2.
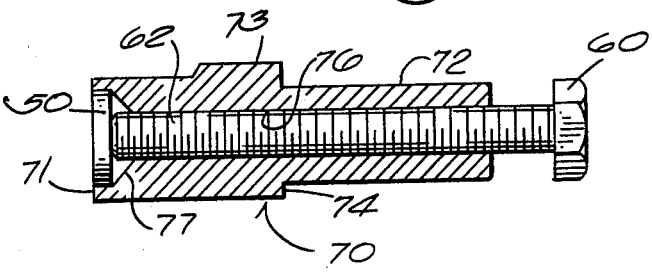
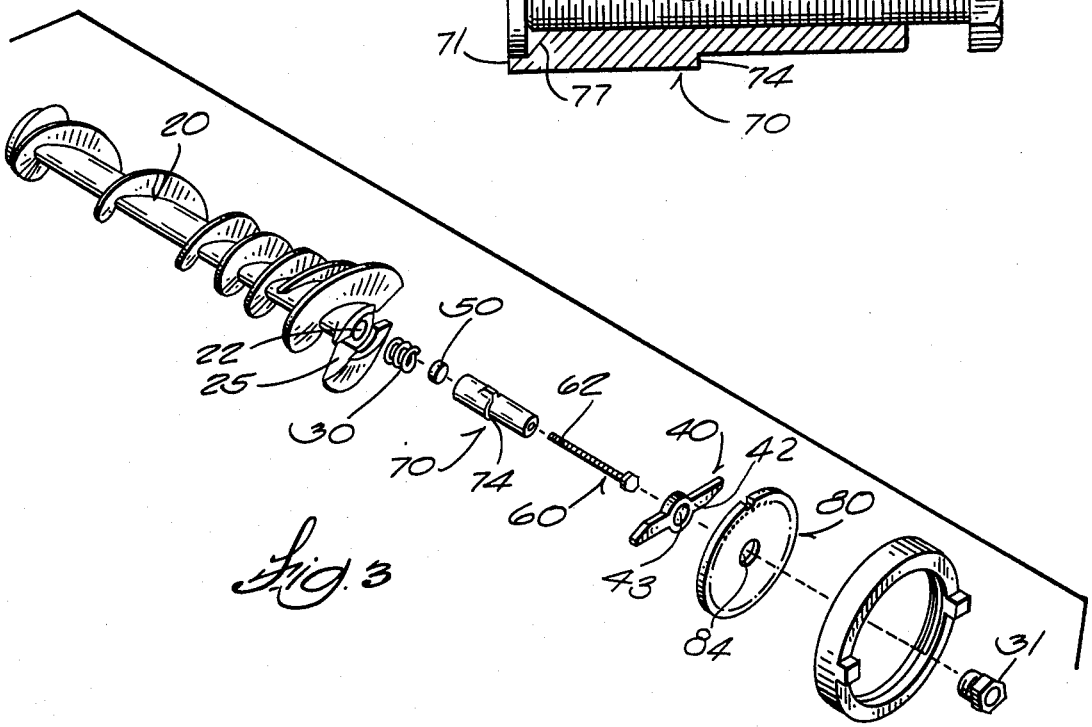
Fig. 3

HOLLOW PIN ASSEMBLY FOR FOOD GRINDERS

BACKGROUND OF THE INVENTION

Heavy duty grinders which are the subject of this invention consist of a food movement tube containing an auger which drives the food toward a perforated die plate. Knives which turn with the auger are biased against the face of the die plate and shear off food particles as they become embedded in the perforations of the die plate, thus effecting the desired grinding action.

One frequent problem with this system is the need to adjust the position of the knife assembly with respect to the perforated plate when one or both of those parts become worn. When bony meat or other materials containing hard parts are ground in the grinder, such wear is quite rapid. Thus, it becomes desirable to provide means to adjust the bias of the knife assembly against the perforated plate of the grinder, without disassembling the grinder. Furthermore, it is desirable that the parts of the bias adjustment mechanism to isolated from the flow of moving food material as much as possible, for sanitary reasons. In the past, any adjustment was internal and required disassembly, and frequently was capable of trapping food particles as well.

My preliminary search disclosed U.S. Pat. Nos. 545,785; 1,021,000; 2,061,005; 2,380,364; 3,536,115; 2,665,725; 3,542,104; Re. 21,817; and Austrian Pat. No. 43,279; British Pat. No. 16,078; and 110,131; Danish Pat. No. 25,071; and German Pat. No. 422,975.

SUMMARY OF THE INVENTION

The present invention relates to bias adjustment means, for food grinders of the type related above, so designed that the bias between the knife assembly and the perforated plate can be adjusted from the outside of the grinder. One end of an outer pin is set in a cavity in the downstream side of the auger. The outer pin passes through the knife assembly and the perforated plate, and a shoulder on the outer pin bears against the knife assembly. An inner pin passes through the outer pin and is threadably connected thereto. The upstream end of said inner pin bears against a compression spring which maintains the bias of the knife assembly against the perforated plate. The downstream end of said inner pin protrudes from the downstream extremity of the outer pin, and the protruding end is adapted to receive a wrench. Rotation of this protruding end threadably advances the inner pin upstream, thus increasing the distance between the shoulder of the outer pin and the upstream end of the inner pin. This results in further compression of the spring, which increases the bias between the knife assembly and the perforated plate. The shoulder on the outer pin bears on the knife to exclude food particles. Adjustment is effected without disassembly or down time.

DESCRIPTION OF DRAWINGS

FIG. 1 is a side view of a food grinder, with the housing shown in vertical longitudinal cross-sectional view to show relevant portions of the interior.

FIG. 2 is an enlarged vertical longitudinal cross-sectional view of the center of FIG. 1.

FIG. 3 is an expanded perspective view of the internal parts of the grinder of FIG. 1.

DESCRIPTION OF PREFERRED EMBODIMENTS

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

FIGS. 1 to 3 depict the preferred embodiment of the present invention.

Food grinder 10 consists of auger tube 11 having an end 13 from which food to be ground is inserted, an auger 20 including shaft 14 to move the food toward the grinding apparatus, perforated plate 80 having perforations 83 into which the food is pressed, and knife assembly 40 which severs the food along the upstream face 81 of plate 80. The severed food then passes through perforations 83 and out of the grinder.

Downstream end 21 of the central shaft 14 of auger 20 has a cavity 22 having an upstream wall 23, a generally cylindrical side wall 24, and a slot 25. Outer pin 70 has an upstream portion 71 within cavity 22. Key 73 on the side of outer pin 70 fits into slot 25 to allow the entire knife bias assembly, consisting of helical spring 30, disc 50, bolt 60, and outer pin 70 in auger cavity 22, to turn along with auger 20. The downstream portion 72 of outer pin 70 passes through central hole 43 of knife assembly 40, then through bushing 31 which fits central hole 84 of perforated plate 80 to receive bolt 60 and which has a hexagonal head to receive a wrench.

Downstream facing shoulder 74 of outer pin 70 presses against the upstream side of knife assembly 40, thus biasing the downstream side 42 of knife assembly 40 against the upstream face 81 of perforated plate 80. Outer pin 70 has a generally cylindrical longitudinal bore with threaded portion 76 and with an enlarged upstream mouth connected by tapering throat 77. Threaded body 62 of bolt 60 engages the threaded bore 76 of outer pin 70. Bolt 60 has a protruding downstream end which is shown with a standard hexagonal head turnable to adjust bolt 60 within bore 75. The upstream end of bolt 60 terminates within throat 77 of bore 76, disc 50 lies within throat 77 contacting the end of bolt 60. Helical compression spring 30, seated between upstream wall 23 of auger cavity 22 and the face of disc 50, maintains a constant bias between knife assembly 40 and perforated plate 80.

To increase the bias between knife assembly 40 and perforated plate 80, or to compensate for wear occurring between said knife and plate, the protruding downstream end bolt 60 is rotated. This in turn pushes disc 50 upstream tending to compress spring 30. This compression is transferred from bolt 60 via threaded bore 76 to outer pin 70, tending to force shoulder 74 downstream, which in turn increases the bias between knife assembly 40 and upstream face 81 of perforated plate 80. To decrease the bias, the protruding downstream end 61 of bolt 60 is rotated in the opposite direction. As a result, the bias can be adjusted easily from the outside, yet the number of parts exposed to the moving mass of food is minimal.

I claim:

1. In a food grinder comprising an auger tube containing an auger and having at its downstream end a perforated plate against the upstream face of which a rotating knife is biased, the improvement comprising an external adjusting means at the downstream end of the grinder to adjust the bias of the knife against the upstream face of the perforated plate, and internal bias means controlled by said external adjusting means without disassembling any part of said grinder, the external adjusting means comprising an inner screw threaded pin having an upstream end and a downstream end, and the internal bias means to adjust the bias of the knife comprising an outer pin in concentric threaded relation to the inner pin, and a compression spring; said inner pin having its upstream end biased by the compression spring and its downstream end accessible from the outside of the grinder; and said outer pin being non-rotatable respecting said auger and said knife and having a downstream facing shoulder bearing against the knife, whereby rotation of the inner pin advances its downstream end against the compression spring to increase the bias of said downstream facing shoulder against the knife, the compression spring and the upstream ends of the inner and outer pins lying within a cavity in the downstream end of the auger.

2. The invention of claim 1, further comprising a disc abutting the upstream end of the inner pin, and wherein the compression spring seats between the disc and the end of the auger cavity.

3. The invention of claim 1, wherein the upstream end of the outer pin has a radially extending key and the cylindrical side wall of the auger cavity has a slot adapted to receive the key to fix the outer pin with respect to the auger.

4. The invention of claim 1 wherein the inner pin passes through a hole in the perforated plate, and a generally annular bushing is interposed between the downstream portion of the outer pin and the hole in the perforated plate through which the outer pin passes, said hole in the perforated plate having a cylindrical threaded inner wall, said bushing having an upstream exterior threaded portion adapted to threadably engage the cylindrical threaded inner wall of the hole in the perforated plate and said bushing having a downstream portion adapted to receive a wrench.

5. In a food grinder comprising an auger tube containing an auger and having at its downstream end a perforated plate against the upstream face of which a rotating knife is biased, the improvement comprising an external adjusting means at the downstream end of the grinder to adjust the bias of the knife against the upstream face of the perforated plate, and internal bias means controlled by said external adjusting means without disassembling any part of said grinder, the external ajusting means comprising an inner screw threaded pin having an upstream end and a downstream end, and the internal bias means to adjust the bias of the knife comprising an outer pin in concentric threaded relation to the inner pin, having its upstream end biased by the compression spring and its downstream end accessible from the outside of the grinder; and said outer pin being non-rotatable respecting said auger and said knife and having a downstream facing shoulder bearing against the knife, whereby rotation of the inner pin advances its downstream end against the compression spring to increase the bias of said downstream facing shoulder against the knife, the outer pin having an opening in its upstream end of greater diameter than the longitudinal bore, said opening being adapted to receive a disc of larger diameter than the upstream end of the inner pin, the compression spring and the upstream ends of the inner and outer pins lying within a cavity in the downstream end of the auger.

6. In a food grinder comprising an auger tube containing an auger and having at its downstream end a perforated plate against the upstream face of which a rotating knife is biased, the improvement comprising:

A. A cavity in the downstream end of the auger, bounded by a cylindrical side wall and an upstream end wall and having a slot in said side wall, parallel to the auger axis, adapted to receive a key;

B. An outer pin received in the auger cavity and having a downstream portion of smaller diameter which passes through the knife and through the perforated plate, a key received by said slot, a downstream facing shoulder formed between the upstream and downstream portions of said outer pin, which shoulder bears against the knife from the upstream side, and a longitudinal bore having a generally cylindrical inner wall with an interior thread, and an opening of greater diameter than the bore at the upstream end of said outer pin;

C. An inner pin passing through the bore in the outer pin, said inner pin having a downstream end protruding from the bore to the exterior of the grinder and rotatable from the exterior of the grinder, a thread on the inner pin engaging the interior thread of the longitudinal bore, and spring seat means lying normally within the said opening of the outer pin but adapted to be advanced upstream therebeyond; and D. A helical compression spring contained within the cavity of the auger and seated between the upstream end wall of the auger cavity and the upstream end of the inner pin;

Whereby rotation of the protruding downstream end of the inner pin advances the inner pin upstream within the outer pin, tending to compress the helical compression spring and thereby to cause the shoulder of the outer pin to increase the bias of the knife against the perforated plate.

* * * * *